United States Patent [19]

Cardone et al.

[11] 4,291,232

[45] Sep. 22, 1981

[54] LIQUID POWERED, CLOSED LOOP POWER GENERATING SYSTEM AND PROCESS FOR USING SAME

[76] Inventors: Joseph T. Cardone, 18348 Lahey St., Northridge, Calif. 91324; Kenneth J. Shatz, 1865 N. Fuller, Hollywood, Calif. 90046

[21] Appl. No.: 55,991

[22] Filed: Jul. 9, 1979

[51] Int. Cl.[3] ..... F01K 25/10

[52] U.S. Cl. ..... 290/1 R; 60/648; 60/671; 60/673; 290/52

[58] Field of Search ..... 60/649, 673, 516; 290/52, 1

[56] References Cited

U.S. PATENT DOCUMENTS

| | | | |
|---|---|---|---|
| 107,206 | 9/1870 | Morley | 60/649 |
| 212,037 | 2/1879 | Molera et al. | 60/649 |
| 3,409,782 | 11/1968 | Bronicki | 290/52 |
| 3,505,810 | 4/1970 | Mamiya | 60/649 |
| 4,009,575 | 3/1977 | Hartman, Jr. et al. | 60/673 |

*Primary Examiner*—J. V. Truhe
*Assistant Examiner*—D. L. Rebsch
*Attorney, Agent, or Firm*—Dressler, Goldsmith, Shore, Sutker & Milnamow, Ltd.

[57] ABSTRACT

A liquid powered, closed loop power generating system which generates power substantially as a result of the flow of a pressurized liquid through its power generating means is disclosed. The liquid flows through the power generating means and into a dissolving means wherein it dissolves a pressurized gas to form a solution, thereby reducing the pressures of both gas and liquid. The solution is separated into gas and liquid whereby both are repressurized. The liquid then flows back to the power-generating means and the gas flows back to the dissolving means, whereby both materials are recycled. A process for generating power is also disclosed.

15 Claims, 2 Drawing Figures

LIQUID POWERED, CLOSED LOOP POWER GENERATING SYSTEM AND PROCESS FOR USING SAME

DESCRIPTION

1. Technical Field

The present invention relates to a closed loop, liquid powered energy system and a process for producing energy therefrom.

2. Background Art

Fossil fuels are presently being used in tremendous quantities throughout the world. The supply of such fuels, particularly oil and natural gas, may be depleted by the twenty first century, while the cost of these fuels has risen several hundred percent in the last ten years. Coal is more plentiful, and presently less expensive than our oil or natural gas, but problems exist with pollutants from the burning thereof. Power from nuclear fission is relatively expensive because of the initial outlays for power plant manufacture; and difficulties arise in handling the waste products from this source of power. Power production from nuclear fusion may not be produced for many years, if ever. The generation of power from solar energy has recently stirred a great deal of interest, but presently, solar power is feasible only in small units, such as for an individual home. Additionally, solar power producing units are extremely expensive to install relative to the amount of useful power obtained; and solar power is less useful in northern climates. Major sources of hydro-electric power have already been tapped in the United States, with only minor sources left for exploitation.

While most of the above-mentioned sources of energy produce heat along with mechanical or electrical power, much of this heat is wasted and exhausts must frequently be cooled before they may enter the surrounding air or water. It has now been found that much of this otherwise "wasted" heat can be utilized to produce additional, useful power.

DISCLOSURE OF INVENTION

This invention relates to a liquid powered, closed loop power producing system which comprises a power generating means for generating power substantially as a result of the flow of a pressurized solvent medium therethrough from an inlet to an outlet. The outlet of the power generating mechanism is connected to a dissolving means to pass the solvent medium thereto. A gas is dissolved in the solvent medium within the dissolving means to produce a solution, thereby lowering the pressure of the gas. Means for separating the dissolved gas from the solvent medium and increasing the pressure of the gas are provided. The separating means contains a body of the solution which includes an upper portion and a lower portion, and also a space above the body of solution. The solution is impelled from the dissolving means to the upper portion of the body of solution in the separating means through appropriate means for connection. The space above the solution in the separating means is connected to the dissolving device to supply the separated gas thereto.

A liquid powered, closed loop power producing process is also disclosed herein. According to this process, a pressurized liquid is supplied to a power generating mechanism for generating power substantially as a result of the flow of liquid there through. The liquid exits therefrom, thereby generating mechanical power. This liquid comprises a solvent medium. A gas is then dissolved in the liquid solvent medium at a zone within a dissolving device wherein the solvent medium comes into direct contact with the gas to form a solution, the solvent medium having a high solvent power for the gas. The dissolution lowers the pressure of the gas relative to the gas pressure prior to dissolution, thereby allowing the gas to flow as a result of the pressure differential. A means for separating the solution having a body of the solution therein is also provided. The body of solution has an upper body portion and a lower body portion and there is a space within separating means above the body of solution. The solution is impelled to the upper body portion of solution within the separating means. Sufficient heat is added to the solution within the separating means to substantially separate the dissolved gas from the solvent medium and thereby increase the pressure of the separated gas and liquid solvent medium. The separated liquid solvent medium is recycled from the lower body portion of solution within the separating means to the power generating mechanism under pressure. The separated gas from the space above the body solution within the separating means is resupplied to the dissolving means.

BRIEF DESCRIPTION OF THE DRAWINGS

In the accompanying drawings forming part of the specification.

DETAILED DESCRIPTION OF THE INVENTION

Figure 1:
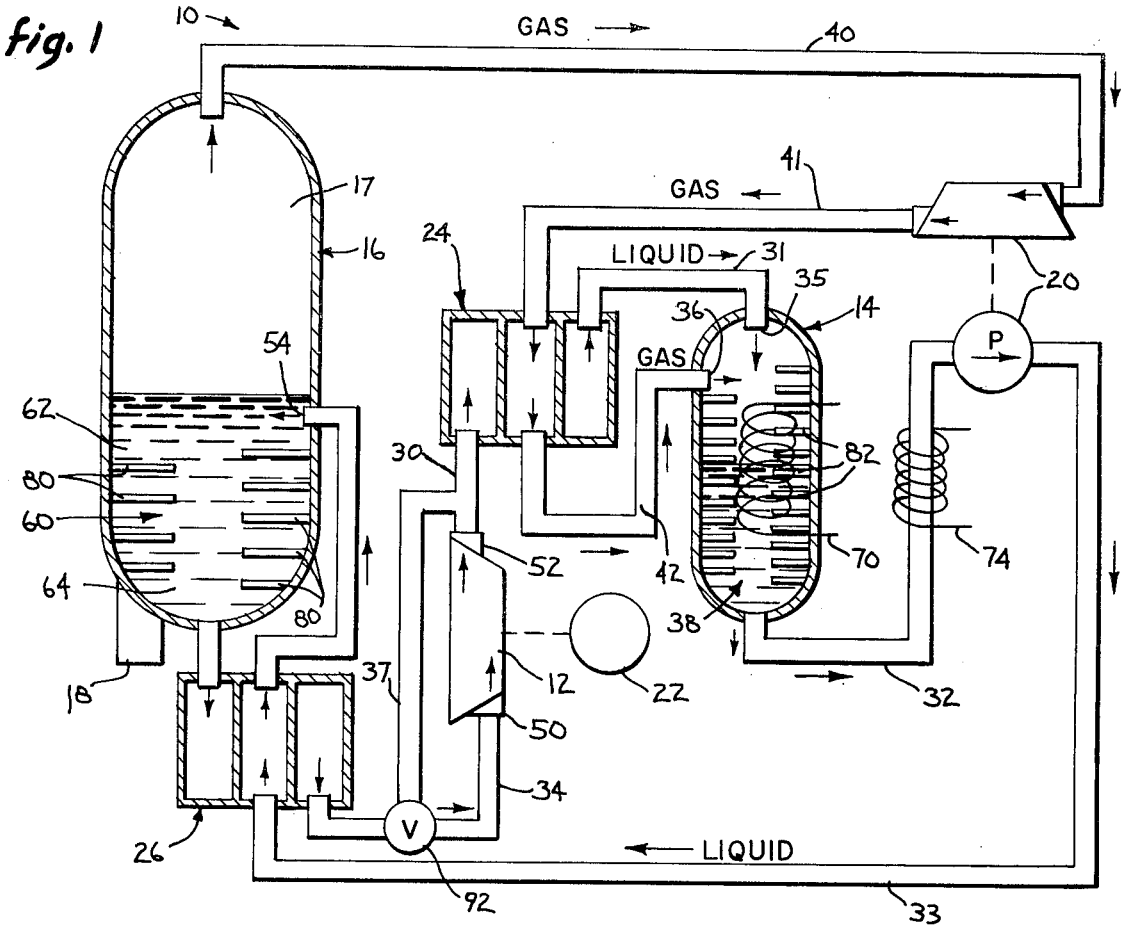
FIG. 1 is a schematic diagram of an embodiment of the liquid powered, closed loop power producing system of the present invention in which arrows indicate the direction of flow within the system.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

In the following description, two digit numerals are used to refer to the embodiment illustrated in FIG. 1, and three digit numerals in the one hundred series are used to refer to the embodiment illustrated in FIG. 2. The same last two digits in each numeral designate similar or functionally analogous elements in the two embodiments.

The power producing system of the present invention operate by means of a liquid flowing from a higher first pressure to a lower second pressure. The high pressure side of the system is created within the separating means by the hydrostatic head of the liquid therein as well as by the pressure caused by distillation of the gas, as is discussed hereinbelow.

The power producing system of the present invention is a closed loop system. By "closed" it is meant that the system's gaseous and liquid components are all contained within the various machinery or piping therein so that there are no intentional openings to the air. The use of the word "loop" herein is to imply that the gaseous and liquid components are used in the system, separated and then reused or recycled, so that barring leaks, once the gaseous and liquid components are charged into the system, they need not be recharged, but are used over and over again.

An embodiment of the present invention is shown schematically in FIG. 1, and is designated generally therein by the numeral 10. The flows of gasses and liquids are labeled as such within FIG. 1 with the direction of flow being indicated by means of arrows. The basic liquid and gas flows shown in the scheme of FIG. 1 are as follows: Liquid under pressure comes from at or near the bottom of the separating apparatus 16 and flows into and through the power generating mechanism 12. The liquid then flows from the power generating mechanism 12 into the dissolving device 14 where it is mixed with the gas to form a solution. The solution is then drawn from the dissolving device 14 into and through an impelling apparatus 20 which pumps the solution back to the separating apparatus at a point at or near the upper portion of the body of solution contained therein, whereby one cycle or loop of the liquid is completed.

The gas flows from the space above the body of liquid within the separating apparatus 16 to and through the impelling apparatus 20, which the gas flow drives, and into the dissolving device at which place it forms a solution with the liquid. The gas which is now dissolved is then pumped back to the separating mechanism as discussed hereinabove along with the liquid, whereby one loop of the gas flow is completed.

The presently preferred gas for use in the systems of this invention is ammonia and the presently preferred liquid solvent medium is water. Other gasses and other solvent media having high solvent power for the gasses may also be used to generate power. Ammonia and water are preferred as they are both relatively inexpensive, and most importantly, ammonia and water have a great affinity for each other. For example, at atmospheric pressure, one ml. of water at 0° C. will dissolve about 1175 ml. of ammonia gas, and at 20° C. one ml of water will dissolve about 700 ml. of ammonia gas.

While ammonia reacts with water to some degree to form ammonium hydroxide, it will evaporate from water at ambient temperatures and can be expelled from solution on heating, whereas other gasses which are also readily soluble in water are either difficult to separate from water, or are themselves more corrosive either as gasses or as water solution than is ammonia. Examples of the latter group of gasses include sulfur trioxide, hydrogen chloride and hydrogen bromide, and the like.

Other solvent media include alcohols, such as ethanol and acids such as acetic, and mixtures thereof with themselves and water. In general, gasses and solvent media are selected which allow at least about 200 volumes of gas to dissolve in one volume of solvent under the conditions that prevail in the dissolving or mixing mechanism.

Ammonia gas and water will be used illustratively herein below as a desirable gas and a liquid solvent medium for the invention. Furthermore, the term "liquid" will be used herein generically to include those components of the system which are flowable at room temperature. The phrase "solvent medium" is used herein to denote a liquid capable of dissolving at least 200 volumes of the gas per liquid volume, and includes water and water-containing ammonia which will still dissolve at least 200 more volumes of ammonia gas. The word "water" is used herein to include both pure water, and as well as water containing some ammonia dissolved therein.

The power generating mechanism 12 of the present invention generates its power substantially as a result of the flow of a liquid therethrough from an inlet 50 to an outlet 52. The power generated by the power generating mechanism is mechanical power, although the mechanical power may result in the formation of electrical energy as when the power generating mechanism 12 is used to drive an electric power generating mechanism 22 such as a generator or an alternator.

The power generating mechanism of the present invention is preferably a turbine which operates by the flow of a liquid therethrough. Such turbines may be similar in design although generally smaller size to those used in hydroelectric plants for the generation of electrical power. Additionally, less sophisticated liquid motivated power producing mechanisms, such as an enclosed water wheel or the like may be used. As used hereinbelow, the word "turbine" or "liquid turbine" will be used synonomously with the phrase "power generating mechanism", and will be designated by the numeral 12. A turbine is shown in both FIGS. 1 and 2, but this invention is not limited to the use of a turbine as a power generating mechanism.

In preferred practice, after going through the turbine 12, the solvent medium, water, leaves via exit or outlet port 52 and flows through conduit means or piping 30, into a heat exchanger 24 wherein the temperature of the water is lowered. The cooled water exits therefrom via conduit 31 whereby it flows into the dissolving device 14 through the inlet 35. The inlet 35 may be simply a pipe or pipe fitting, or it may also be a nozzle designed to break up the incoming water flow so that better contact is made between the incoming water and gas in the mixing apparatus. Upon entering the dissolving mechanism 14, the incoming water comes into direct contact with the incoming gas at a zone therein to assure rapid mixing of these components.

Upon dissolution of the ammonia in the water, a great deal of heat is given off as the heat of solution, about 8.4 kilocalories per mole, using pure reactants. The solution is therefore preferably cooled within the dissolving mechanism 14 to assist in alleviating any back pressures which may be built up due to this heat of solution and also to cool the solution so that it may be pumped from the dissolving device 14 without the pump cavitating due to evolution of the dissolved gas therein. Suitable cooling of the solution 38 within the dissolving mechanism 14 may be achieved by the use of a cooling means such as the cooling coil 70 shown in FIG. 1.

In preferred practice, the heat liberated on dissolution of the gas in the solvent medium is not wasted. Rather, this heat is used to warm another part of the system which needs warming. Thus, for example, this heat may be transferred via the coils 70 or 74 to further increase the temperature of the gas in the conduits 41 or 42. Additionally, this heat may be used as part of the heat input to the separating apparatus 16 by thermally interfacing coils 70 or 74 with it. When the heat solution is used to help heat the separating apparatus, and thereby reduce the amount of external heat input, additional cooling of the circulating heat transfer medium may be needed so that the disolving device 14 and the solution 38 therein, or the solution within the conduit 32 will be sufficiently cooled to allow pumping as described hereinabove. Other uses may also be found for this heat output.

The cooled solution is then pumped from at or near the bottom of the dissolving mechanism 14 through conduit means 32 by and through the impelling means or pump 20. Thereafter, the solution is led by conduit means 33 back to the separating means 16.

The separating apparatus 16 is basically a distillation apparatus. It contains a body of solution 60, having an upper body portion 62 and a lower body portion 64 thereof. The solution is impelled into the separating apparatus 16, preferably, at a place in the upper body portion 62 of the solution therein at which the concentration of ammonia in the separating apparatus 16 is about equal to that of the incoming solution. The incoming solution enters via the solution inlet 54.

Heat must be supplied to the solution 60 within the separating apparatus 16 to distill the ammonia from the water and thereby separate the gas from the liquid phase. A heating means 18 is shown schematically in FIG. 1 to supply the necessary heat. This heating may be derived directly from the use of fossil fuel such as coal, oil or gas to heat the solution or by electric heating.

One advantage of the present power producing system is that the temperatures needed to drive the system are relatively low compared with those used in conventional coal or nuclear powered generating systems. Thus, temperatures less than about 500°–600° F. may be used to drive the system of this invention. Thus, the present invention lends itself to the use of what would be otherwise waste heat. Sources of waste heat sufficient to run the power producing system of this invention may be found in many industrial situations such as plants where fossil fuels are used for the generation of steam and/or power, steel or aluminum producing facilities and the like.

In the embodiment of this invention shown schematically in FIG. 1, part of the heat input required for separating the ammonia gas from the solution may be achieved by thermally interfacing the separated solvent medium with the returning solution to be separated. An example of such thermal interfacing is shown in FIG. 1 by the heat exchanger 26 wherein the returning solution is heated by the separated solvent.

It has been found that as ammonia is driven off from the solution 60, a concentration gradient in the ammonia-water solution 60 is achieved within the separating apparatus 16. The ammonia-water solution 60 being less dense than water itself, solutions containing larger quantities of ammonia tend to remain in the upper portion 62 of the body of solution 60, while solutions containing less ammonia tend to settle near the bottom of the distillation apparatus in the lower portion 64 of the solution. It is therefore preferred that the entering ammonia-water solution from conduit 33 be introduced to the upper portion 62 of the solution 60 within the separation apparatus at a place at which the concentration of ammonia caused by the gradient is about that of the entering solution. This placement of the solution inlet 54 lessens disruptions to the distillation process caused by introduction of less concentrated, new, solution into the more concentrated, uppermost portion of the distilling solution 60. Means, such as baffles 80, may be employed to prevent substantial mixing of the solution 60 to help assure that the upper body portion 62 and lower body portion 64 maintain their respective differential ammonia concentrations.

Separated water, suitable for reuse or recycling is removed at or near the bottom of the separating apparatus 16 from the lower portion 64 of the solution therein. The recycled solution flows through conduit means 34 and turbine inlet 50 into the turbine 12. Thus, one cycle or loop of the liquid flow is completed.

The separated ammonia flows from the space 17 above the body of solution 60 within the separating apparatus 16 through conduit 40 and into the gas driven pump or impeller 20. The flow of gas through the impeller drives the pump connected thereto which pumps solution from the dissolving mechanism 14 to the separating apparatus 16.

On leaving the gas powered impeller portion of the impeller pump 20, the gas is cool relative to the temperature at which it entered. This cooling may be a result of the work done by the gas in the impeller, or may simply be due to the expansion of the gas as it passes therethrough. The cooled gas exits the impeller-pump 20 by conduit means 41 and is then led through a heat exchanger 24 wherein the cooled ammonia gas is warmed by the solution which exited from the turbine 12.

The now warmed gas then flows through conduit means 42 and gas inlet 36 into the dissolving device 14. As was the case with the water inlet 35, the gas inlet 36 may be a pipe or pipe fitting, or a nozzle designed to improve the direct contact of the ammonia gas with the water so that dissolution of the gas in the water may occur advantageously. Additionally, use of a further means for contacting the ammonia and water such as the baffles 82 within the dissolving device can assist in hastening ammonia dissolution. The rate that the water can flow through the turbine 12 and into the dissolving device 14 in part governs the power output of the system. Thus, the faster the gas can be dissolved, the faster the liquid can flow, and the more power output may be achieved.

Upon dissolution of the ammonia in the water, the dissolved ammonia flows out of the dissolving mechanism 14, through the impeller-pump 20 and then back into the separating apparatus 16 to thereby complete one loop or cycle of the ammonia gas flow.

The efficiency of the above liquid powered, closed loop power producing system 10 is a function, inter alia, of the temperature and pressure within the separating apparatus 16, the volume and rate of flow of the solvent medium turning the blades in the turbine 12, the rate of gas and liquid flows, the design of the turbine 12, the concentration of ammonia within the water, as well as the temperatures of the gaseous and liquid components in this system. The values chosen for the above parameters are largely determined by economic considerations and will vary with the particular configuration chosen for use. However, these values are easily obtained by those skilled in the art.

The liquid powered, closed loop power producing system 10 may be stopped by means of the valve 92 in conduit 34 which can be used to shunt the separated solvent medium around the turbine 12. The valve 92 and shunting conduit 37 may also be used as a throttle to adjust the amount of water flowing through the turbine 12 and thus the rate at which the turbine turns and the power output. The heating means 18 should be shut off if the system is desired to be shut down completely.

To start the system, the steps described hereinabove for stopping power generation would be reversed. Thus, the heating means 18 would be "on" to cause the gas-liquid separation, and the valve 92 would allow the separated solvent medium to flow therethrough to the turbine 12. In addition, a mechanical starting means may be necessary to begin turning of the liquid powered turbine 12.

Figure 2:
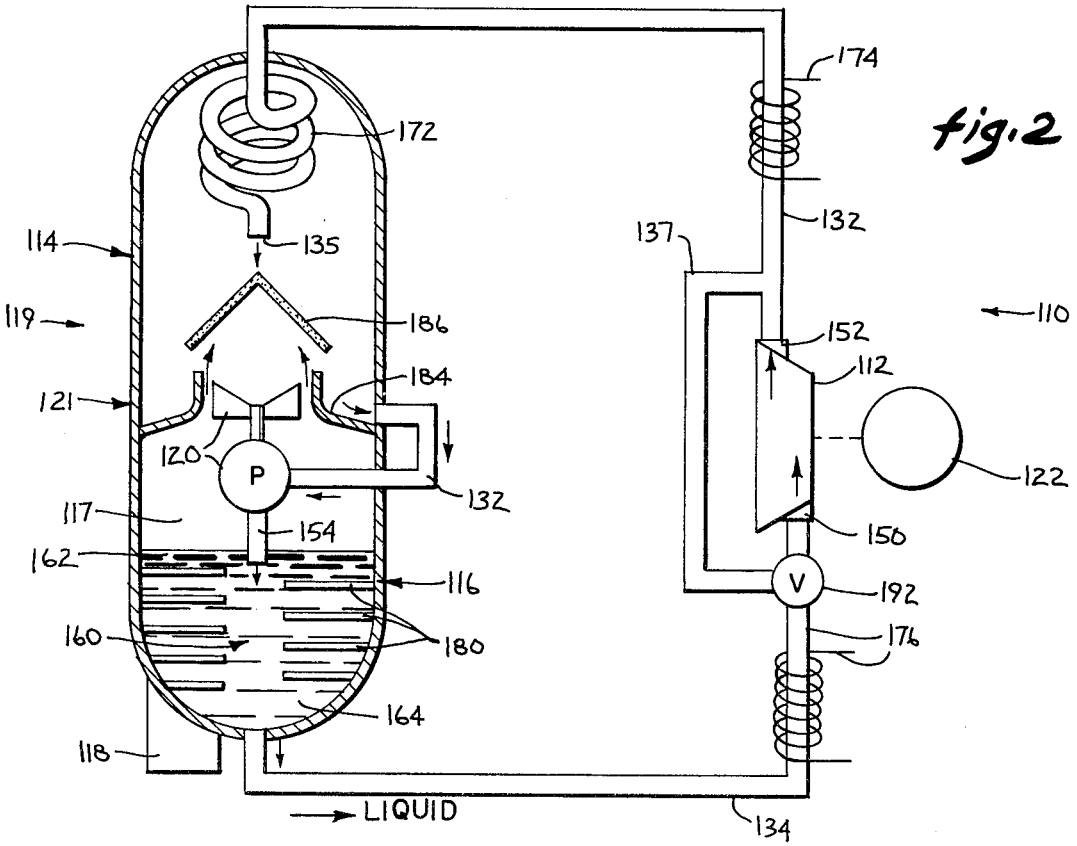
FIG. 2 is a schematic diagram of another embodiment of the present invention in which arrows indicate the direction of flow.

Another embodiment of the present invention is shown schematically in FIG. 2. In this embodiment, the separating, dissolving and solution return functions of the system are all housed in one apparatus, with only the power generating mechanism and its connecting conduits external thereto. The basic gaseous and liquid flows are as follows, beginning with the liquid flow: the separated solvent medium, again preferably water, flows from near the bottom of the separating apparatus through conduits and into and through the power generating mechanism, again, preferably a turbine. The water then flows out of the turbine and back into the vessel wherein the dissolution and separation functions are carried out. On entry into this vessel, the liquid is cooled and then directly contacts the gas, again preferably ammonia, rising from the separation portion of the vessel to thereby form a solution. The solution collects in a trough which surrounds the gas powered impelling means and is pumped or impelled back into the separating portion of the vessel by the gas powered impeller.

Looking now at the various components shown in the schematic diagram of FIG. 2 wherein the liquid powered, closed loop power producing system is shown generally by the numeral 110, a vessel 119 is provided wherein the combined functions of separation, dissolution and pumping or impelling of the solution produced therein back for separation are carried out. The combined function vessel 119 is comprised generally of three portions. The lower portion 116 of the vessel carries out the separating functions. The upper portion 114 carries out the dissolution functions, and the middle portion 121 carries out the pumping or impelling function whereby the solution is returned to the separating region.

The separating portion 116 of the vessel 119 is preferably a distillation apparatus and contains a body of the ammonia-water solution 160. This body of solution 160 has an upper portion 162, a lower portion 164 and a space thereabove 117. As stated hereinabove in regard to the scheme shown in FIG. 1, during separation, solution containing more ammonia tends to be in the upper portion 162 while solution containing less ammonia tends to be in the lower body portion 164 of the solution 160 within the separating region 116. Baffles 180 may be used to help maintain the ammonia gradient within the solution 160 and help prevent mixing of the solution, as discussed hereinabove.

Heat must also be supplied to separate the ammonia from the solution. Once again, the heat input may come from various sources, as discussed hereinabove. The heating means 118 may be comprised of one or more of these heat sources.

The separated solvent medium, or water, is forced out of the separating portion 116 of the vessel 119 at or near the bottom thereof, from the lower portion 164 of solution therein. This separated solvent is forced from the vessel by the pressure of the hydrostatic head of solvent within the vessel, as well as by the pressure of the gas being distilled from the solution therein. The separated water flows within conduit means or piping 134 and into the inlet 150 of the liquid power generating mechanism or turbine 112. The liquid powered turbine 112 may be similar to those discussed hereinabove and may similarly be connected to an electric power generating mechanism such as a generator or alternator 122. After passing through the turbine 112, the water exits via outlet 152 and flows into conduit means 132 which carries the water back to the vessel 119 wherein the solution of ammonia in water is reformed.

Since ammonia is more soluble in cold water than in warmer water, the water entering the dissolving portion 114 of the vessel 119 should be cooled prior to its contacting and dissolving the ammonia. This cooling may be achieved by coils or other means 172 placed within the upper or dissolving portion 114 of the vessel. Additionally, or in the alternative, the water may be cooled prior to its entry into the turbine 112 by means such as cooling coil 176, or it may be cooled after leaving the turbine 112 as for instance by cooling coil 174.

On being separated from the upper portion 162 of the body of solution 160, the ammonia gas flows upward under pressure, driving a gas powered pump 120, preferably a turbine powered pump as is known in the art; the gas pressure being created by the heat required to separate the gas from the solution 160. On passing through the turbine, the ammonia gas is cooled both by its expansion into a relatively larger volume and by the work that it has done in turning the turbine blades.

The cooled gas then flows through and/or around (upwardly in FIG. 2) a porous baffle 186 so constructed that the gas may pass therethrough, but the liquid solution formed thereabove (as described hereinbelow) will not substantially pass therethrough and into the gas powered turbine therebelow. The preferred shape for the porous baffle 186 is that of a cone, having its apex upward, or in the direction of the inlet 135 for the returning solvent medium.

On passing through and around the porous baffle 186, the cooled gas then directly contacts and dissolves in the returning water coming into the dissolving region 114 of the vessel 119 at a zone therein which may generally be defined as the region between the return water inlet 135 and the upper surface of the porous baffle 186. The particular dimensions and configuration of the zone of contact and dissolution of the gas in the solvent medium is dependent, inter alia, upon the configuration of the porous baffle 186, the return solvent medium inlet 135, the configuration in which the return solvent leaves the inlet 135, that is as a stream of liquid or a shaped mist, or the like, and the distance between the inlet 135 and the baffle 186.

Upon formation of the ammonia-water solution, a great deal of heat is generated as discussed hereinabove. The hot solution is directed to a trough 184, which preferably surrounds the gas exiting portion of the gas powered turbine driven pump 120, by the configurations of the vessel 119, the porous baffle 186 and the returning water after it leaves the inlet 135.

The hot solution collected in trough 184 is fed by conduit 132 into the pump portion of a gas powered turbine driven pump 120, which pump or impeller portion returns the solution to the separating portion 116 of the vessel 119 and the solution 160 therein via the pump exit port (or solution inlet) 154. As stated hereinabove, the newly formed solution preferably enters the upper body portion 162 of the solution 160 at a place at which the concentration of ammonia in the entering solution approximately equals the ammonia concentration in the distilling solution. Thus, the flows of liquid and gas in the system shown in FIG. 2 are completed.

When used in a configuration similar to that shown in FIG. 2, gravity may be used to assist the pumping action of the gas powered impeller 120 and thus, cavitation problems in the pump portion are minimized. Thus, the heat generated on dissolution of the gas may be used to lower the amount of externally supplied heat needed to separate the gas from the solution.

The liquid powered, closed loop power producing system 110 of FIG. 2 may be stopped by means of valve 192 in conduit means 134 which can be used to shunt the separated solvent medium through conduit means 137 and around the turbine 112. The valve 192 and shunting conduit 137 may also be used as a throttle to adjust the rate at which the water flows through turbine 112. Thus, if the valve 192 is partly open so that liquid may flow into the conduit 137, less liquid will flow into and through the turbine 112 thereby lowering its power output. Of course, should the system be desired to be shut off entirely, the heating means 118 should also be shut down.

To start this system, the steps described hereinabove for stopping the generation of power would be reversed. That is, the heating means 118 would be on to cause the gas-liquid separation and valve 192 would allow the separated solvent medium to flow therethrough to the turbine 112. In addition, a mechanical starting means may be necessary to begin turning of the liquid powered turbine.

In addition to the various cmponents described hereinabove in regard to both FIGS. 1 and 2, various other control valves, pressure release valves, pressure indicators, temperature indicators and the like may be incorporated into the system as is desired.

Energy is produced in the liquid powered closed loop power producing systems of this invention by the following steps: a pressurized liquid is supplied to a generating mechanism for generating power substantially as a result of the flow of liquid therethrough, and allowing the liquid to enter and exit therefrom, thereby generating mechanical power. The liquid comprises a solvent medium. A gas is dissolved in the liquid solvent medium at a zone within a dissolving device wherein the solvent medium comes into direct contact with the gas to form a solution. The solution of the gas in the solvent medium lowers the pressure of the gas relative to the gas pressure prior to the dissolution whereby the gas flows as a result of the pressure differential. A means for separating the solution having a body of solution therein is also provided. The body of solution has an upper body portion and a lower body portion and there is a space within the separating means above the body solution. The solution so formed is impelled into the upper body portion of the solution within the separating means. Sufficient heat is added to the solution within the separating means to substantially separate the dissolved gas from the solvent medium and thereby increase the pressure of the separated gas and the separated liquid solvent medium. The separated liquid solvent medium is recycled under pressure from the lower body portion of the solution within the separating means to the power generating means. The separated, pressurized gas powers the impeller which pumps newly formed solution into the upper body portion of solution within the separating means. Additionally, both the solvent medium and gas may be cooled prior to their being contacted and dissolved, one within the other.

The above detailed description has been given for ease of understanding only. No unnecessary limitations are to be understood therefrom, as modifications will be obvious to those skilled in the art. The invention is defined by the claims which follow.

I claim:

1. A liquid powered, closed loop power generating system comprising:

(a) a power generating means for generating power substantially as a result of the flow of a pressurized solvent medium therethrough from an inlet to an outlet;

(b) means for physically dissolving a gas in said solvent medium to produce a solution, thereby lowering the pressure of said gas and maintaining said flow of said solvent medium; said dissolving means containing said solution therein, and having gas and solvent medium inlets located above said solution, the incoming gas and incoming solvent medium coming into direct contact at a zone within said dissolving means;

(c) means for separating said dissolved gas from said solvent medium in said solution and increasing the pressure of said gas, said separating means containing a body of said solution therein, including an upper portion and a lower portion of said body, and containing a space above said body of solution;

(d) means for connecting said space above said body of solution in said separating means to said dissolving means to supply said separated gas thereto;

(e) means for connecting said outlet of said power generating means to said dissolving means to pass said solvent medium thereto;

(f) means for connecting said dissolving means to the upper portion of the body of solution in said separating means, and means for impelling said solution to said upper portion of said body of solution; and (g) means for supplying the separated solvent medium from the lower portion of the body of solution in the separating means to said inlet of said power generating means, whereby the separated solvent medium is recycled into the power generating system.

2. The closed loop power generating system of claim 1 including a cooling means between said power generating means and said dissolving means.

3. The closed loop power generating system of claim 1 wherein said impelling means is driven by the flow of said separated gas from said separating means to said dissolving means.

4. The closed loop power generating system of claim 1 wherein said separating, dissolving and impelling means are all within one vessel, said vessel comprising a lower portion comprising means for separating said solution, an upper portion comprising means for dissolving said gas in said solvent medium to thereby form said solution, and a middle portion comprising means for impelling said formed solution to said separating means.

5. A closed loop power generating system comprising:

(a) a turbine for generating power substantially as a result of the flow of a pressurized solvent medium therethrough from an inlet to an outlet;

(b) means for physically dissolving ammonia gas in said solvent medium to produce a solution, thereby lowering the pressure of said gas;

(c) means for separating said dissolved gas from said solvent medium in said solution and increasing the pressure of said gas and said solvent medium, said separating means containing a body of said solution therein including an upper body portion and lower body portion, and containing a space above said body of solution;

(d) means for impelling said solution to said upper portion of said body of solution, said impelling means being driven by the flow of said gas from said separating means to said dissolving means, said separating, dissolving and impelling means being all within one vessel, said vessel comprising a lower portion comprising said separating means, an upper portion comprising means for dissolving said ammonia in said solvent medium to thereby form said solution, and a middle portion comprising means for impelling said formed solution to said separating means;

(e) means for connecting said space above said body of solution in said separating means to said dissolving means to supply said separated gas thereto;

(f) means for connecting said dissolving means to the upper portion of the body of solution in said separating means;

(g) means for cooling said separated solvent medium prior to said dissolution;

(h) means for connecting said space above said body of solution in said separating means to said dissolving means to supply said separated gas thereto; and (i) means for supplying the separated solvent medium from said lower portion of said body of solution in the separating means to said inlet of said power generating means, whereby the separated solvent medium is recycled into the power generating system.

6. A closed loop power generating system comprising:

(a) a turbine for generating power substantially as a result of the flow of a pressurized solvent medium therethrough from an inlet to an outlet;

(b) means for physically dissolving ammonia gas in said solvent medium to produce a solution, thereby lowering the pressure of said gas and maintaining said flow of said solvent medium; said dissolving means containing said solution therein, and having gas and solvent medium inlets located above said solution, the incoming ammonia gas and incoming solvent medium coming into direct contact at a zone within said dissolving means;

(c) means for cooling said separated solvent medium prior to said dissolution;

(d) means for separating said dissolved gas from said solvent medium in said solution and increasing the pressure of said gas and said solvent medium, said separating means containing a body of said solution therein including an upper body portion and lower body portion, and containing a space above said body of solution;

(e) means for connecting said space above said body of solution in said separating means to said dissolving means to supply said separated gas thereto;

(f) means for connecting said outlet of said power generating means to said dissolving means to pass said solvent medium thereto;

(g) means for connecting said dissolving means to the upper portion of the body of solution in said separating means;

(h) means for impelling said solution to said upper portion of said body of solution, said impelling means being driven by the flow of said separated gas from said separating means to said dissolving means; and (i) means for supplying the separated solvent medium from the lower portion of the body of solution in the separating means to said inlet of said power generating means, whereby the separated solvent medium is recycled into the power generating system.

7. The closed loop power generating system of claim 6 wherein said separating, dissolving and impelling means are all within one vessel, said vessel comprising a lower portion comprising means for separating said solution, an upper portion comprising means for dissolving said ammonia in said solvent medium to thereby form said solution, and a middle portion comprising means for impelling said formed solution to said separating means.

8. The closed loop power generating system of claim 5 wherein said dissolving means comprises a porous baffle, said baffle being so constructed that the ammonia gas may pass therethrough to form a solution thereabove, but said solution will not substantially pass therethrough.

9. The closed loop power generating system of claim 8 wherein said baffle has the shape of a cone with its apex upward and is placed in said vessel above said impelling means.

10. A liquid powered, closed loop power generating process comprising the steps of:

(a) maintaining a body of solution comprising ammonia gas dissolved in a liquid solvent medium within the lower portion of a vessel, said vessel having a confined space above said body of solution, an upper portion thereabove and an impeller between said upper portion and said confined space, and said body of solution having an upper body portion and a lower body portion;

(b) adding sufficient heat to said body of solution to continuously separate said dissolved ammonia gas from said liquid solvent medium to thereby increase the pressure of said separated gas and said separated liquid solvent medium;

(c) supplying said separated, pressurized, liquid solvent medium from said lower body portion of said solution to a power generating means for generating power substantially as a result of the flow of said liquid solvent medium therethrough, and allowing said liquid solvent medium to enter and exit therefrom thereby generating mechanical power;

(d) flowing said liquid solvent medium into the upper portion of said vessel;

(e) physically dissolving ammonia gas in said liquid solvent medium at a dissolving zone within said upper portion of said vessel wherein said solvent medium comes into direct contact with said ammonia gas to produce a newly formed solution, said solvent medium having high solvent power for said ammonia gas and said dissolution lowering the pressure of said ammonia gas and maintaining said flow of said liquid solvent medium;

(f) impelling said newly formed solution into said upper body portion of said solution within the lower portion of said vessel; and (g) resupplying said continuously separated, pressurized ammonia gas from said confined space above said body of solution to said dissolving zone, said pressurized gas powering the impeller for said newly formed solution.

11. The process of claim 10 wherein said pressurized ammonia gas passes through and around a porous baffle and then directly contacts said liquid solvent medium, said porous baffle being so constructed that said newly formed solution will not substantially pass therethrough.

12. The process of claim 11 wherein said porous baffle has the shape of a cone with its apex upward and is placed in said vessel above said impeller.

13. A liquid powered, closed loop power generating process comprising the steps of:

(a) maintaining a body of solution comprising a gas dissolved in a liquid solvent medium in a separating means, said body of solution having an upper body portion and a lower body portion, and said separating means having a space above said body of solution;

(b) adding sufficient heat to said body of solution to continuously separate said dissolved gas from said liquid solvent medium to thereby increase the pressure of said separated gas and said separated liquid solvent medium;

(c) supplying said separated, pressurized, liquid solvent medium from said lower body portion of said solution to a power generating means for generating power substantially as a result of the flow of said liquid solvent medium therethrough, and allowing said liquid solvent medium to enter and exit therefrom thereby generating mechanical power;

(d) flowing said liquid solvent medium from said power generating means into a dissolving means containing a newly formed solution of liquid solvent medium containing said dissolved gas, liquid solvent medium entering said dissolving means through an inlet located above said newly formed solution contained therein;

(e) physically dissolving said separately pressurized gas in said flowing liquid solvent medium within said dissolving means, said gas entering said dissolving means through a second inlet located above said solution, said entering gas and liquid solvent medium coming into direct contact at a zone within said dissolving means to produce said newly formed solution, said dissolution thereby lowering the pressure of said gas and maintaining said flow of said liquid solvent medium;

(f) impelling said newly formed solution into said upper body portion of said solution in said separating means; and (g) resupplying said continuously separated, pressurized gas from said space above said body of solution in said separating means to said dissolving means, said pressurized gas powering the impeller for said newly formed solution.

14. The process of claim 13 comprising the additional step of cooling said separated liquid solvent medium prior to dissolving said gas therein.

15. The process of claim 13 wherein said liquid solvent medium comprises water.

* * * * *